US007828959B2

(12) United States Patent
Ganji

(10) Patent No.: US 7,828,959 B2
(45) Date of Patent: Nov. 9, 2010

(54) DELAYED COKING PROCESS AND APPARATUS

(76) Inventor: Kazem Ganji, 404 Flint Ridge Ct., Norman, OK (US) 73072

( * ) Notice: Subject to any disclaimer, the term of this patent is extended or adjusted under 35 U.S.C. 154(b) by 386 days.

(21) Appl. No.: 11/942,564

(22) Filed: Nov. 19, 2007

(65) Prior Publication Data

US 2009/0127090 A1 May 21, 2009

(51) Int. Cl.
*C10B 55/04* (2006.01)
*C10G 9/14* (2006.01)

(52) U.S. Cl. ..... 208/50; 208/125; 208/131

(58) Field of Classification Search ..... 208/50, 208/125, 131
See application file for complete search history.

(56) References Cited

U.S. PATENT DOCUMENTS

| | | | | |
|---|---|---|---|---|
| 1,729,307 | A | | 9/1929 | Dubbs |
| 2,072,524 | A | | 3/1937 | Mace |
| 2,093,588 | A | | 9/1937 | Forward |
| 2,132,639 | A | | 10/1938 | Morrell |
| 3,344,057 | A | | 9/1967 | Patrick |
| 3,917,564 | A | | 11/1975 | Meyers |
| 3,928,170 | A | | 12/1975 | Takahashi et al. |
| 4,049,538 | A | * | 9/1977 | Hayashi et al. ..... 208/50 |
| 4,066,513 | A | * | 1/1978 | Jablin ..... 201/39 |
| 4,176,052 | A | | 11/1979 | Bruce et al. |
| 4,257,778 | A | * | 3/1981 | Murakami et al. ..... 208/14 |
| 4,295,956 | A | | 10/1981 | Metrailer |
| 4,404,092 | A | | 9/1983 | Audeh et al. |
| 4,443,328 | A | | 4/1984 | Sakurai et al. |
| 4,477,334 | A | | 10/1984 | Gomi et al. |
| 4,487,686 | A | | 12/1984 | Gomi et al. |
| 4,501,654 | A | | 2/1985 | Allan |
| 4,521,277 | A | | 6/1985 | Calderon et al. |
| 4,522,627 | A | | 6/1985 | Gomi et al. |
| 4,581,124 | A | | 4/1986 | Gomi et al. |
| 4,612,109 | A | | 9/1986 | Dillon et al. |
| 4,661,241 | A | | 4/1987 | Dabkowski et al. |
| 4,666,585 | A | | 5/1987 | Figgins et al. |
| 4,816,136 | A | | 3/1989 | Allan et al. |
| 4,839,023 | A | | 6/1989 | Mayer et al. |
| 4,874,505 | A | | 10/1989 | Bartilucci et al. |
| 4,919,843 | A | | 4/1990 | Innertsberger et al. |
| 4,954,240 | A | | 9/1990 | Eidt, Jr. et al. |
| 4,961,840 | A | | 10/1990 | Goyal |

(Continued)

OTHER PUBLICATIONS

"Eureka Cracking", 1976, pp. 112, vol. 55, No. 11, Publisher: Hydrocarbon Processing, Published in: US.

(Continued)

*Primary Examiner*—Walter D Griffin
*Assistant Examiner*—Renee Robinson
(74) *Attorney, Agent, or Firm*—Fellers, Snider, Blankenship, Bailey & Tippens, P.C.; Dennis D. Brown

(57) ABSTRACT

A delayed coking process and apparatus which greatly shorten the required duration of the alternating drum fill and decoking cycles and eliminate the need to perform drum quenching, draining, unheading, hydraulic decoking, reheading, pressure testing, and warming procedures in the decoking cycle. In the inventive system, the decoking cycle preferably comprises simply a steamout stage and a coke product draining procedure. The coke product produced in the coking drums is a hot, solid, flowable material from which heat can be recovered for preheating the coker feed and/or producing steam.

15 Claims, 3 Drawing Sheets

U.S. PATENT DOCUMENTS

| | | | | |
|---|---|---|---|---|
| 4,968,407 | A | 11/1990 | McGrath et al. | |
| 4,969,988 | A | 11/1990 | Jain et al. | |
| 4,994,169 | A | 2/1991 | Godino et al. | |
| 5,007,987 | A | 4/1991 | Block et al. | |
| 5,024,730 | A | 6/1991 | Colvert | |
| 5,068,024 | A | 11/1991 | Moretta et al. | |
| 5,169,560 | A | 12/1992 | Hart | |
| 5,296,132 | A | 3/1994 | Hart | |
| 5,389,234 | A | 2/1995 | Bhargava et al. | |
| 5,389,299 | A | 2/1995 | Hart | |
| 5,430,216 | A | 7/1995 | Kerby et al. | |
| 5,439,489 | A | 8/1995 | Scalliet et al. | |
| 5,443,717 | A | 8/1995 | Scalliet et al. | |
| 5,597,474 | A | 1/1997 | Kerby et al. | |
| 5,667,669 | A | 9/1997 | Hart | |
| 6,117,308 | A | 9/2000 | Ganji | |
| 6,171,473 | B1 | 1/2001 | Fornoff | |
| 6,764,592 | B1 | 7/2004 | Ganji | |
| 7,303,664 | B2 * | 12/2007 | Siskin et al. | 208/131 |
| 7,727,382 | B2 * | 6/2010 | Sparks et al. | 208/131 |
| 2003/0098260 | A1 | 5/2003 | Newman et al. | |
| 2005/0123466 | A1 | 6/2005 | Sullivan | |
| 2007/0108036 | A1 * | 5/2007 | Siskin et al. | 201/21 |

OTHER PUBLICATIONS

"Flexicoking Conversion Technology", Nov. 28, 2005, Publisher: Internet Article by ExxonMobile Research and Engineering.

"Fluid Coking Conversion Technology", Nov. 28, 2005, Publisher: Internet Article by ExxonMobil Research and Engineering Company, Published in: US.

International Search Report Mailed Dec. 2, 2008.

* cited by examiner

IMPROVED DEALYED COKER UNIT
FEED FLASH SECTION

IMPROVED DELAYED COKER UNIT
COKING SECTION

OFF GAS
66
NAPHTHA
67
LCGO
68
LHCGO
69
CRUDE UNIT
FRACTIONATOR
(FIG. 1)
94
FEED
FLASH
DRUM
HEATER
10
COKER
FRAC.
HHCGO
DRUM
"B"
DRUM
"A"
PT
PT
HEATER
SUPERHEATED STEAM
91
92
SUPERHEATED STEAM
HC VAPOR
93
HEAVY RESID /HEAVY RAW CRUDE
STEAM GENERATOR
HEAT EXCHANGERS
BFW
STEAM
COKE PRODUCT

DELAYED COKING PROCESS AND APPARATUS

FIELD OF THE INVENTION

The present invention relates to processes and apparatuses for the delayed coking of heavy petroleum materials.

BACKGROUND OF THE INVENTION

Delayed coking systems are commonly used in petroleum refineries for converting vacuum tower bottoms and/or other heavy (i.e., high boiling point) residual petroleum materials to petroleum coke and other products. The greater part of each barrel of resid material processed in the cocker will typically be recovered as fuel gas, coker gasoline/naphtha, light cycle oil (also commonly referred to by various other names such as light coker gas oil), and heavy cycle oil (also commonly referred to by various other names such as heavy coker gas oil).

A typical delayed coking system comprises: a combination tower or other fractionator; a fired heater; and at least a pair of vertical coking drums. The heavy coker feed is typically delivered to the bottom of the fractionator where it is combined with a heavy residual bottom product, commonly referred to as "recycle," produced in the fractionator. The resulting mixture is drawn from the bottom of the fractionator and then pumped through the heater and into at least one coking drum. Typically, multiple coking drums are operated in alternating cycles such that, while one drum (referred to herein as the "live" drum) is operating in a fill cycle, another drum is operating in a second cycle typically comprising: a steamout to fractionator stage; a steamout to blow down stage; a cooling/quenching stage (which causes the coke to form a solid mass within the drum); a draining stage; a drum unheading stage; a hydraulic de-coking stage for cutting the solid coke mass into chunks; a reheading and pressure testing stage; and a warmup/preheating stage.

In the fill cycle, the hot feed material from the coker heater typically flows into the bottom of the live coking drum. Some of the heavy feed material vaporizes in the beater such that the material entering the bottom of the coking drum is a vapor/liquid mixture. The vapor portion of the mixture undergoes mild cracking in the coker heater and experiences further cracking as it passes upwardly through the coking drum. The hot liquid material undergoes intensive thermal cracking and polymerization as it remains in the coking drum such that the liquid material is converted to cracked vapor and petroleum coke. The resulting combined overhead vapor product produced in the coking drum is typically delivered to a lower portion of the fractionator. The cracked vapor product is typically separated by the fractionator into gas, naphtha, light cycle oil, and heavy cycle oil, which are withdrawn from the fractionator as products, and a heavy recycle/residual material which flows to the bottom of the fractionator. The light and heavy cycle oil products are typically taken from the fractionator as side draw products which are further processed (e.g., in a fluid catalytic cracker) to produce gasoline and other desirable end products. The heavy recycle material combines with the heavy feed material in the bottom of the fractionator and, as mentioned above, is pumped with the heavy feed material through the coker heater.

By way of example, but not by way of limitation, typical coker operating conditions and products specifications include: a coker heater outlet temperature in the range of from about 905° to about 935° F.; live coke drum pressures in the range of from about 20 to about 40 psig; live drum overhead temperatures in the range of from about 800° to about 820° F.; a fractionator overhead pressure in the range of from about 10 to about 30 psig; a fractionator bottom temperature in the range of from about 750° to about 780° F.; a light cycle oil draw temperature in the range of from about 450° to about 550° F.; a light cycle oil initial boiling point (ASTM D-1186) in the range of from about 300° to about 325° F.; a light cycle oil endpoint D-1186 in the range of from about 600° to about 650° F.; a heavy cycle oil draw temperature in the range of from about 600° to 690° F.; a heavy cycle oil initial boiling point (D-1186) in the range of from about 470° F. to about 500° F.; and a heavy cycle oil end point (D-1186) in the range of from about 960° to about 990° F.

There is currently a trend in the U.S. refining industry toward the processing of heavier, lower cost crudes. This results in refiners having to contend with much larger quantities of residual materials in the refining process. This, in turn, increases the demands on the refinery's residual conversion processes, especially delayed coking. Since the greater part of a barrel of residuum (such as, e.g., the high boiling point bottom products from atmospheric or vacuum distillation columns) can be converted to light ends, gasoline, distillate, and gas oil in a coker, the coker has become even more important in today's refinery economics.

Unfortunately, coking systems are often the principal bottleneck in many refineries when it comes to increasing refinery production rates and to improving product quality. The operation of a delayed coking system is a combination batch-continuous process. While one drum is live (i.e., is being filled with hot feed material), another drum is being stripped, quenched, decoked, and warned. Then, at the end of the filling cycle, the operation of the drums is switched. This cycle of events results in significant variations in the composition of the vapor feed to the fractionator over time and generates numerous operating problems associated with this type of operation, such as pressure swings, temperature swings, etc. Thus, the flow of feed and recycle material from the bottom of the coker fractionator to the coker heater, although continuous, is subject to considerable fluctuation due to the effect of drum switching operations and other factors which greatly influence fractionator stability. In addition, other problems commonly experienced in delayed coking systems include foaming, drum foam-over, inefficient liquid product recovery, inferior coke and liquid product quality, and extended drum cycle length.

The time required for drum filling and decoking operations in delayed coking systems has also severely limited the maximum achievable throughput for these systems. By way of example, the coking drums used in existing delayed coking processes will typically operate on about 18 hour cycles. Thus, while one drum is operating in an 18 hour filling cycle, another drum will undergo an 18 hour decoking cycle. A typical 18 hour decoking cycle involves: about 0.5 hours for the steamout to fractionator operation; about 1.0 hours for the steamout to coker blowdown operation; about 5.5 hours for the water quench/fill operation; about 2.0 hours for the quench water draining operation; about 0.5 hours for the drum unheading operation; about 3.0 hours for the decoking (i.e., hydraulic cutting) operation; about 1.0 hours for reheading the coking drum and conducting a pressure test to verify that the drum has not been damaged; and about 3.5 hours for warming the drum with steam to return it to operating temperature.

In addition to all of the other problems, shortcomings, and disadvantages discussed above, the specialized hydraulic decoking apparatuses required for use in the prior art delayed coking systems are very costly to obtain, install, and maintain. Moreover, the drum quenching and fill procedures required in the prior art processes waste tremendous amounts of heat and generate large volumes of waste water which must be processed in the refinery's wastewater treatment system. Further, the tremendous drum temperature swings experienced between the coking, quenching, and other stages of the prior art process, as well as the unheading and reheading of the coking drums for decoking, place tremendous stresses on the coking drums and create a significant potential for drum damage and downtime.

The delayed coking processes and systems heretofore used in the art are also limited in terms of the maximum heater outlet temperature which can be employed. The maximum coker heater outlet temperature employed in the present delayed coking systems generally cannot exceed 935° F. and most preferably will not exceed 930° F. The use of higher heater outlet temperatures results in the production of a very hard coke product which is very difficult to cut and remove. However, this maximum temperature limit prevents the resid feed material from being fully cracked. Consequently, some heavy liquid material remains in the green coke product. By failing to fully crack the resid feed and leaving some of the heavy liquid material in the coke product, the overall product yield is reduced and the coke product has an undesirable volatile organic carbon (VOC) content.

Consequently, a need exists for an improved delayed coking process and apparatus which alleviates or eliminates the various problems, limits, and shortcomings of the delayed coking processes and systems heretofore used in the art.

SUMMARY OF THE INVENTION

The present invention provides an improved delayed coking process and an improved delayed coking apparatus which satisfy the needs and alleviate the problems and shortcomings discussed above. The inventive process and apparatus can be used for constructing and operating new delayed coking systems or for improving existing delayed coking systems. Moreover, in addition to processing traditional coker feed materials such as atmospheric or vacuum resid, the inventive process and apparatus can be used for processing deasphalter bottom products, fluid cat cracker bottom products, oil sands bitumen, tar sands, Orinoco heavy oil, and similar materials and can also be used for the direct processing of heavy crudes. When used for the direct processing of crude oil streams, tar sands, etc., the inventive process also eliminates the need for conducting crude desalting and feed pretreatment blending procedures.

Further benefits and advantages of the inventive delayed coking process and apparatus include, but are not limited to: allowing each drum filling cycle and each drum decoking cycle to be completed in as little as from about four to about eight hours; eliminating the need to purchase, install, and maintain hydraulic decoking systems for the coker drums; eliminating the need to perform the steamout to blowdown, quenching, quench draining, unheeding, hydraulic cutting, reheading, pressure testing, and warming procedures heretofore required in the prior art; allowing the recovery of a significant amount of the heat heretofore wasted in the drum quenching and other procedures; using the energy recovered from the coke product for feed preheating and/or steam production; significantly reducing the amount of waste water produced; and allowing the use of significantly higher coking temperatures.

These improvements also result in: the ability to significantly increase system throughput; more stable and consistent vapor feed compositions and operating conditions in the coker fractionator; increased liquid product yields and improved quality; reduced coke yield; significantly less VOCs in the coke product; reduced foaming problems and a reduced need for antifoam additives; eliminating the potential for damage to the coking drums heretofore posed by major temperature swings and the repeated performance of drum unheading and reheading operations during the decoking cycle; and much lower operating and maintenance costs.

In one aspect, there is provide a process for producing a petroleum coke product in a delayed coking system. The delayed coking system includes a plurality of coking drums with the process comprising each coking drum operating in alternating cycles, including a fill cycle followed by a second cycle. During the fill cycle, a drum feed material is delivered into the coking drum to form the coke product therein and produce a vapor product which is delivered to a product fractionator. During the second cycle, the drum feed material is not delivered into the coking drum. The process further comprises the step in the second cycle of removing from the coking drum the coke product which has been formed therein without quenching the coke product with water or other quenching liquid in the coking drum and without cutting the coke product in the coking drum such that, when removed from the coking drum in the removing step, the coke product is a flowable material which flows out of the second coking drum in solid form.

In another aspect, there is provided an apparatus for delayed coking comprising: a flash vessel wherein a heated petroleum feed stream will separate into a flash vapor product stream and a flash liquid product stream; a fired heater through which the flash liquid product stream will be delivered and heated to a coking temperature; a plurality of delayed coking drums which will receive the flash liquid product stream at the coking temperature in alternating cycles to produce a coke product and a cracked vapor product; and a heat exchanger through which the coke product from the coking drums will flow in solid form for recovering heat from the coke product.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
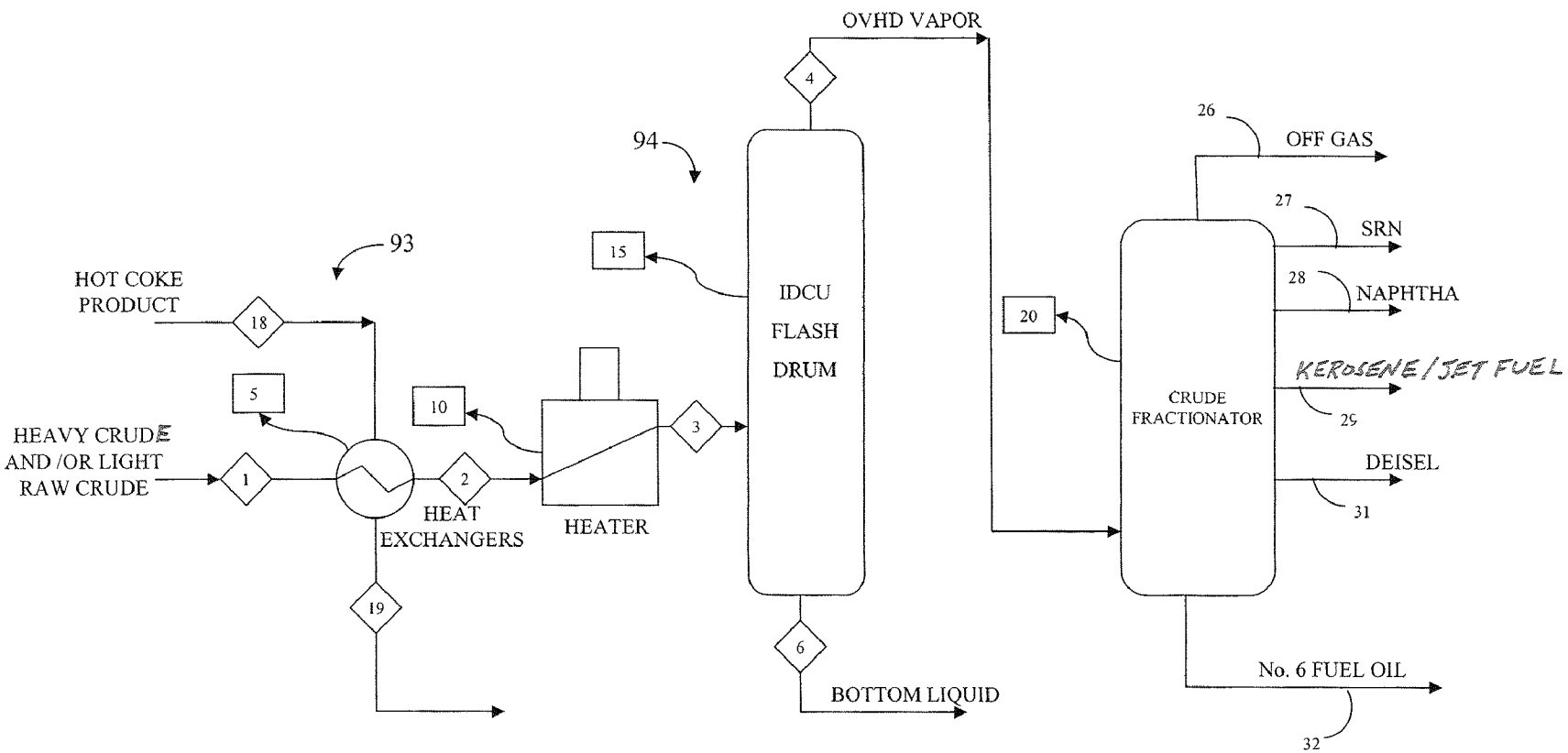
FIG. 1, schematically illustrates an embodiment of a feed flash section of the inventive delayed coking apparatus and process.
Figure 2:
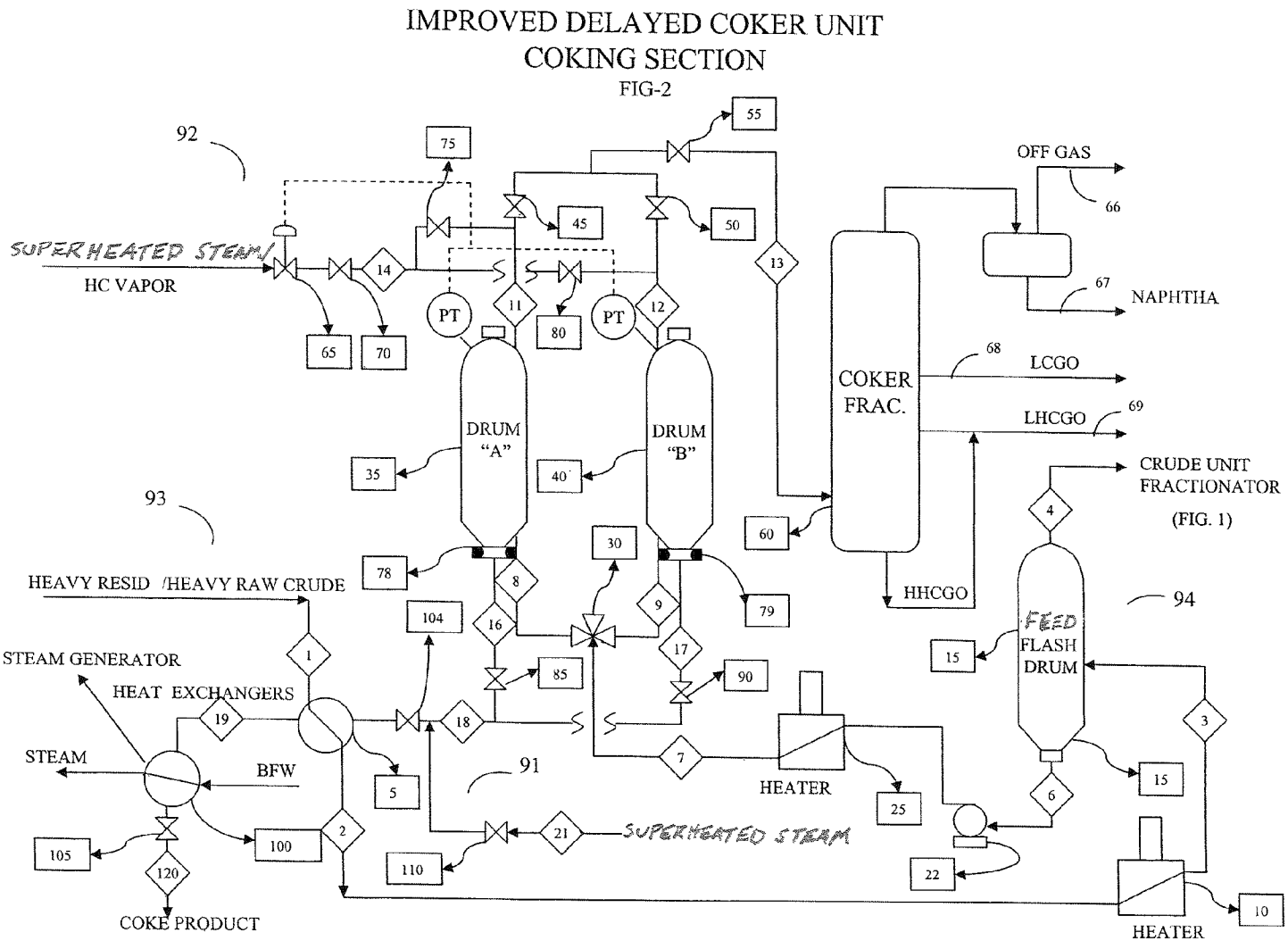
FIG. 2 schematically illustrates an embodiment of a coking section of the inventive delayed coking apparatus and process.
Figure 3:
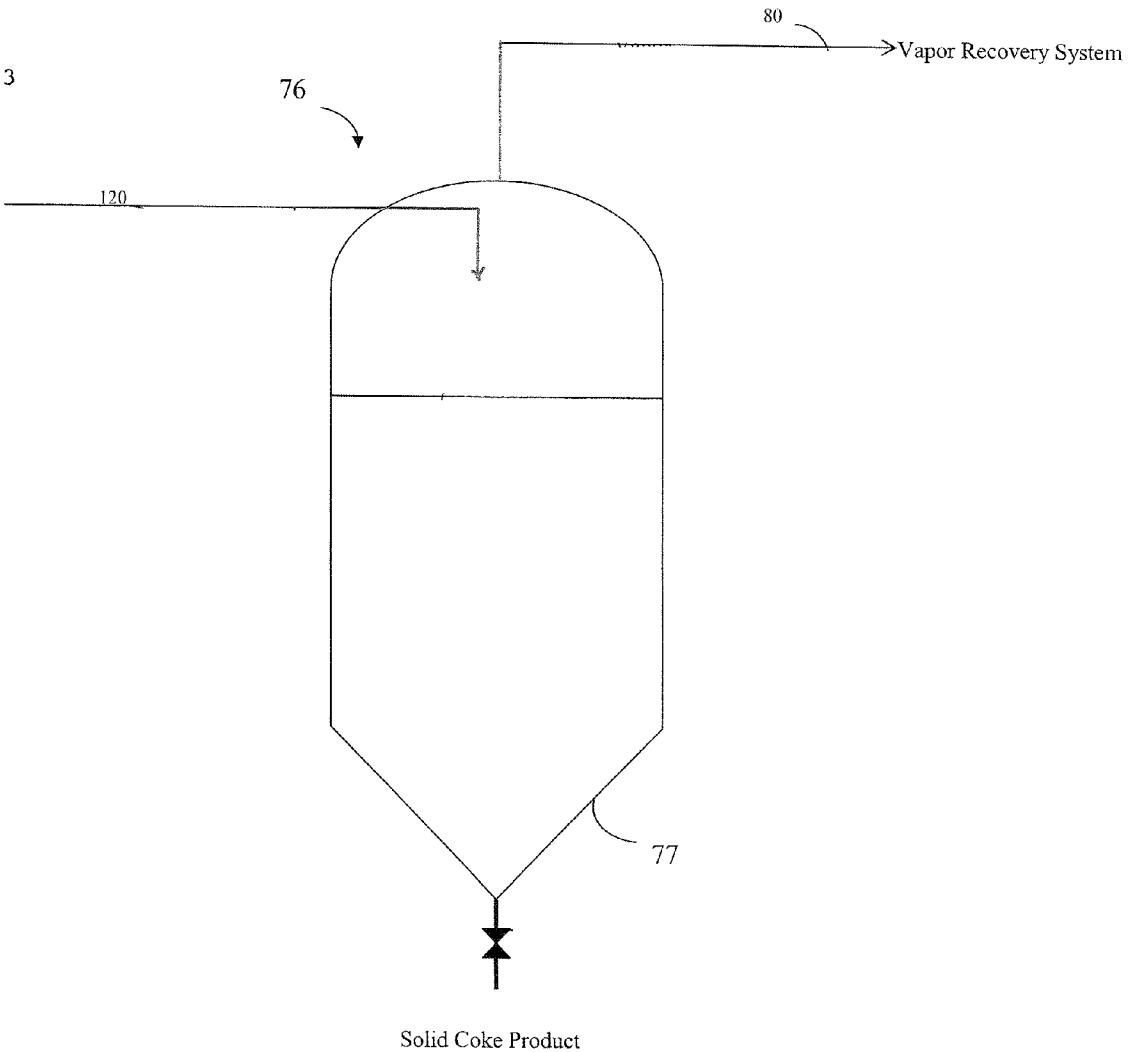
FIG. 3 schematically illustrates an embodiment of a coke product storage vessel 77.

An embodiment of the inventive delayed coking process and apparatus is illustrated in FIGS. 1-3. As described hereinbelow, the inventive system preferably comprises: a plurality of (i.e., at least two) delayed coking drums 35, 40; a coker feed delivery and preheat system 93; a coker heater 25; a coker product fractionation column 60; a coke product steam purge system 91; a coke drum pressurization system 92 for drum decoking operations; and a downstream product coke storage system 76.

The embodiment of the inventive delayed coking system as shown in FIGS. 1 and 2 also includes a feed flash system 94 comprising a feed flash drum 15 and a vapor product fractionator 20. As shown in FIG. 2, the liquid product from the feed flash drum 15 is preferably fed directly through the coker heater 25 and into a live coking drum 35 or 40. However, the liquid product from the feed flash vessel could alternatively be fed to the coker fractionator 60 such that the feed to the coker heater 25 would then be a bottom product from the fractionator 60. Moreover, as yet another alternative, the inventive system could operate without the use of a preheated feed flash system such that the coker feed itself would be directly delivered to the coker fractionator 60.

The coker feed preheat system 93 and flash system 94 shown in FIGS. 1 and 2 comprise: a coker feed line 1; one or more feed preheat exchangers 5 wherein the coker feed is heated by the coke product flowing from one or more of the coking drums 35, 40; a fired heater 10 downstream of the preheat exchanger(s) 5 for further heating the coker feed material; a line 2 for delivering the feed material from the preheat exchanger(s) 5 to the heater 10; a line 3 for delivering the preheated feed material from the heater 10 to the feed flash drum 15; and a flash drum overhead line 4 for delivering the flash drum vapor product from the flash drum 15 to the flash vapor fractionator 20.

As mentioned above, the inventive system is well suited for processing a wide variety of possible feed materials. Examples include, but are not limited to, atmospheric resid streams, vacuum resid streams, oil sands bitumen, tar sands, heavy whole crudes, other raw crude oils, de-asphalter bottoms, and fluid cat cracker bottoms. In contrast to prior refinery operations, the inventive system allows refinery feedstocks such as heavy whole crudes and tar sands to be processed without first having to desalt the crude or tar sand material. The inventive system can also be operated without feed pretreatment blending. Desalting operations are often problematic for heavy crude and tar sand materials and require the use of expensive electric desalting systems and emulsion breaking chemicals. Such desalting procedures also produce significant amounts of waste water.

The temperature of the feed material delivered to the inventive delayed coking system via line 1 will typically be in the range of from about 150° to about 500° F. The fired heater 10 will preferably be operable for heating the feed material to a temperature in the range of from about 600 to about 850° F. (more preferably at least 750° F. and most preferably at least 800° F.) for delivery to the feed flash drum 15. The feed flash drum 15 will typically be operated at a pressure in the range of from about 10 to about 30 psig and will preferably be sized to ensure that the vapor velocity therein is sufficiently low to prevent solid particles or liquid droplets from being entrained in the flash vapor product. The vapor velocity within the feed flash drum will most preferably be in the range of from about 0.4 to about 0.9 feet per second.

The amount of heat recovered in the preheat exchanger(s) 5 will depend to a large degree on the actual type and profile of the feed material. By way of example, if the feed material delivered to the inventive coking system is a heavy raw crude, the temperature of the material leaving the preheat exchanger (s) 5 will typically be in the range of from about 450 to about 600° F.

As schematically illustrated in FIG. 1, the vapor product from the feed flash drum 15 can be distilled in the vapor product fractionator 20 to produce an array products. If the feed to the inventive delayed coking system is a heavy raw crude or other feed material of similar composition, the operation of the flash vapor fractionator 20 will preferably be similar to that of an atmospheric crude distillation column which produces: an overhead off gas product 26; an overhead light liquid product (e.g., straight run gasoline) 27; a naphtha side draw product 28; a kerosene (jet fuel) side draw product 29; a diesel side draw product 31; and at least one fuel oil/gas oil side draw and/or bottom product 32. In yet another embodiment, the flash vapor fractionator 20 can actually be a raw crude fractionator or similar system operating elsewhere in the refinery.

The liquid product from the bottom of the feed flash drum 15 is delivered to the coker heater 25 via a flash drum bottoms line 6 using a heater charge pump 22. The coker heater 25 heats the flash liquid material to a suitable coking temperature for delivery to one or more of the coking drums 35, 40.

The inventive system could be employed using a single coking drum which simply alternates between fill and decoking cycles above. However, in order to more closely approximate the operation of a continuous process, the inventive delayed coking system will preferably operate using a plurality of coking drums (i.e., at least two or more) operating in alternating cycles such that, when one or more of the coking drums 35 is operating in a fill cycle, one or more other drums 40 will be operating in a decoking cycle.

When the drum 35 shown in FIG. 2 is operating in a fill cycle, the hot coker feed will be delivered into the bottom of the coking drum 35 from the coker heater 7 via coker heater outlet line 7, switch valve 30, and conduit 8. When the coking drum 40 is operating in the fill cycle, the hot coker feed will be delivered to the bottom of drum 40 via the heater outlet line 7, switch valve 30, and line 9.

The coker heater 25 will preferably be effective for heating the drum feed material to a temperature in the range of from about 905° F. to about 1050° F. As mentioned above, the inventive system allows the drum feed material to be beneficially heated to a higher temperature than can be used in prior delayed coking systems. The use of a higher coking temperature in the inventive system improves cracking and vapor product yield and reduces the amount of liquid remaining in the coke product. In one high temperature embodiment, the coke drum feed will be heated to a temperature exceeding 935° F. In another high temperature embodiment, the coke drum feed will be heated to a temperature of at least 940° F. In another high temperature embodiment, the coke drum feed will be heated to a temperature of at least 950° F. In another high temperature embodiment, the coke drum feed will be heated to a temperature of at least 960° F. The temperature of the coke drum feed in the inventive system will preferably be in the range of from about 920° F. to about 980° F.

As also mentioned above, the present invention significantly reduces the time required for both the filling cycle and the decoking cycle of the delayed coking process. In fact, the cycle times required by the inventive process will typically be less than one-half, and will preferably require only one-third, of the time required by prior delayed coking operations. Each cycle will preferably not exceed 10 hours. More preferably, each cycle will last for from about 4 to about 8 hours and will most preferably be completed in about 6 hours.

In the decoking cycle (referred to herein and in the claims as the "second cycle"), the inventive process eliminates several procedures and systems required in the prior art delayed coking processes. The procedures and stages eliminated by the inventive system include: the steamout to blowdown operation (typically about 1 hour); the quench/fill operation (typically about 5.5 hours); the quench water drainage procedure (typically about 2 hours); the drum unheading procedure (typically about 0.5 hours); the hydraulic cutting/decoking procedure (typically about 3.0 hours); the drum reheading and pressure testing procedures (typically 1.0 hour); and the drum warming procedure required before commencing the next fill cycle (typically about 3.5 hours). As a result of the tremendous amount of time heretofore required for performing these various procedures, the fill and decoking cycles in the prior delayed coking systems have typically been about 18 hours in length.

In contrast, the decoking (second) cycle of the inventive process preferably comprises only (a) a steamout to fractionator stage to remove any remaining volatile hydrocarbons from the coke product and (b) a green coke draining stage. In the green coke drainage stage, the hot, unquenched coke product produced by the inventive process flows from the bottom of the coke drum in the form of a free flowing solid material. The flowable coke product will typically be somewhat spherical in shape with a mean particle size in the range of from 50 to about 400 μm. The mean particle size of the solid green coke material will more typically be in the range of from about 100 to about 250 μm.

As mentioned above, the duration of each of the drum fill and drum decoking cycles in the inventive process will typically be in the range of from about 4 to about 8 hours with the steamout to fractionator stage accounting for from about 0.3 to about 1.0 hours of the second cycle. For a system operating on six hour cycles, the steamout to fractionator stage of the second cycle will typically require about 0.5 hours and the green coke draining stage will typically require about 5.5 hours.

It will also be understood that although, as indicated, the steam and hydrocarbon effluent produced in the steamout stage of the second cycle will preferably be sent to the coker fractionator, the effluent could alternatively be sent to the blowdown system or elsewhere.

The coke drum steamout/purge system 91 used in the inventive system preferably comprises a line 21 which provides superheated steam (preferably at from about 750° to about 1000° F.) from the refinery steam system. The purge steam from line 21 is delivered into the bottoms of the coking drums 34 and 35 via the drum coke product lines. Thus, when the coking drum 40 is operating in the steamout to fractionator stage of the decoking (second) cycle of the inventive delayed coking operation, valves 110 and 90, shown in FIG. 2, will be open and the superheated steam will be delivered into the bottom of drum 40 via lines 21, 18, and 17. Similarly, if drum 35 is operating in the steamout to fractionator stage of the decoking (second) cycle, valves 110 and 85 will be open and the superheated steam will be delivered into the bottom of drum 35 via lines 21, 18, and 16.

During the fill cycle and the steamout to fractionator stage of the decoking cycle, the cracked vapor product or steamout vapor effluent will be delivered from the top of the particular coking drum 35, 40 in question to the coker fractionator 60. Thus, when coking drum 35 is operating in either the fill cycle or the steamout to fractionator stage of the decoking cycle, the overhead valves 45 and 55 shown in FIG. 2 will be open and the vapor product from the top of coking drum 35 will be delivered to the fractionator 60 via the drum 35 overhead line 11 and the fractionator feed line 13. Similarly, when the coking drum 40 is operating in either the fill cycle or the steamout to fractionator stage of the decoking cycle, valves 50 and 55 shown in FIG. 2 will be open and the vapor product from drum 40 will be delivered to the fractionator 60 via the drum 40 overhead line 12 and the fractionator feed line 13.

The cracked vapor product produced in the coking drums 35, 40 during each drum fill cycle will typically be at a temperature in the range of from about 880 to about 980° F. In addition, during the fill cycle, the live drum(s) will typically operate at an overhead pressure in the range of from about 15 to about 40 psig.

The coker fractionator 60 will typically operate at a pressure in the range of from about 10 to about 30 psig and can be configured to provide any type of product profile familiar to the art. In the embodiment of the inventive system shown in FIG. 2, the coker fractionator 60 operates to separate the cracked vapor product from the coking drum 35 or 40 into: an overhead off gas product 66; an overhead light liquid product (e.g., cracked naphtha) 67; a light coker gas oil side draw product 68; and a heavy or combination heavy and intermediate coker gas oil product 69.

During the coke draining stage of the decoking cycle, the hot solid coke product which is formed in drum 35 or 40 is preferably conducted through one or more of the feed preheat exchangers 5 discussed above and then through another exchanger (e.g., a steam generator 100) for producing steam from boiler feed water. In view of the flowable solid nature of the hot coke product material, the preheat exchanger(s) 5 used in the inventive process for recovering heat from the solid coke will preferably be hybrid shell and tube-type exchangers. As will be understood by those in the art, hybrid-type exchangers are commonly used, for example, for recovering heat from catalyst regeneration systems in fluid catalytic cracker (FCC) processes.

Similarly, the steam generator 100 used for recovering heat from the flowable solid coke product to produce steam from boiler feed water will preferably be a shell and tube exchanger of the type used in the coker units for recovering heat from a heavy gas oil pumparound stream.

The temperature of the solid coke product leaving the bottom of the drum 35 or 40 will typically be in the range of from about 920 to about 980° F. The coke product will typically be cooled to a temperature in the range of from about 600 to about 700° F. in the feed preheat exchanger(s) 5 and will preferably be further cooled to a temperature in the range of from about 150 to about 250° F. in the steam generator 100. The cooled coke product is delivered from the steam generator 100 to a coke storage vessel 77 via line 120.

To assist in ensuring that the solid coke product particles are within a uniform particle size range for delivery through the feed preheat exchanger(s) 5 and the steam generator 100, crushers 78 and 79 can be installed on the bottoms of coke drums 35 and 40. The crushers 78 and 79 also crush any coke chunks in the drum.

As will be understood by those in the art, each crusher 78, 79 could be a device of the type currently used on coking drums in some refineries to crush the larger coke chunks produced in prior art cutting operations. The crushers 78, 79 would be adapted for the smaller and hotter coke product produced in the inventive process.

As another alternative, the crushers 78 and 79 could be replaced with strainers sized to retain any chunks of sufficient size to get caught in the downstream equipment. Any chunks caught in the strainers would be dumped periodically during drum switching operations and handled separately.

When the coking drum 40 is being operated in the solid coke draining stage of the decoking cycle, then the valves 90, 104, and 105 shown in FIG. 2 will be open so that the coke product draining from the bottom of drum 40 will pass through crusher 79 and then flow to the coke product vessel 77 via line 17, line 18, preheat exchanger(s) 5, line 19, steam generator 100, and line 120. If, on the other hand, the coking drum 35 is operating in the solid coke draining stage of the decoking cycle, then valves 85, 104, and 105 will be open so that the solid coke product flowing from the bottom of drum 35 will pass through crusher 78 and then flow to the coke product vessel 77 via line 16, line 18, feed preheat exchanger (s) 5, line 19, steam generator 100, and line 120.

To further assist in causing the solid coke product to flow from the bottoms of the coking drums 35, 40 in a desired manner, the present invention provides a drum pressurization system 92 for pressurizing the drums 35, 40 with superheated steam, hydrocarbon vapor, or a combination thereof, during the coke draining stage. The drum pressurization system 92 is preferably operable for pressurizing the drums 35, 40 with superheated steam at a temperature in the range of from about 750 to about 1000° F. The drum pressurization system preferably delivers the superheated steam or hydrocarbon vapor to the top of the drum(s) 35 or 40 in question and preferably includes a pressure control valve 65 for controlling the addition of superheated steam or hydrocarbon vapor to the drum 35 or 40 in order to maintain a desired set pressure therein. If measured at the top of the drum, the set pressure will preferably be in the range of from about 40 to about 300 psig. If measured at the bottom of the drum, the set pressure will preferably be in the range of from about 70 to about 400 psig.

When the coking drum 40 is operating in the coke product draining stage of the decoking cycle, valves 70 and 80 of the drum pressurization system 92 will be open and the superheated steam or hydrocarbon vapor pressurizing fluid will be delivered to the top of drum 40 via control valve 65, line 14, and line 12. On the other hand, if the coking drum 35 is operating in the coke draining stage of the decoking cycle, then valves 70 and 75 of the pressurization system 92 will be open and the pressurizing steam or hydrocarbon vapor will be delivered to the top of drum 35 via control valve 65, line 14, and line 11.

To also assist the flow of the solid coke material from the bottom of the coking drums 35 and 40 during the coke draining stage, ring-type steam nozzles (not shown) can additionally be provided in the bottoms of drums 35 and 40 for further fluidizing the solid coke product material at the bottoms of the drums and in the coke product discharge system.

In view of the fact that it is not necessary during the decoking (second) cycle of the inventive process to fill the coking drum with quench water and then unhead the drum and perform a hydraulic decoking operation, and also in view of the fact that the entire decoking cycle is significantly shorter than required in prior processes, the coking drum 35 or 40 will remain at a sufficient temperature at the completion of the hot coke draining process such that it will not be necessary to warm the drum prior to beginning the next fill cycle. In addition, the ability of the inventive process to eliminate the drum quenching, unheading, hydraulic decoking, and reheading stages of the delayed coking process eliminates the potential for damage to the coking drums due to the thermal and physical stresses associated therewith.

Example

A 27 API Arabian crude feed is delivered to the inventive delayed coking system shown in FIGS. 1-3 at a rate of 12,000 barrels per stream day (BPSD) and a temperature of 150° F. The feed is heated to a temperature of 550° F. in the feed preheat exchanger(s) 5 and is further heated to a temperature of 750° F. by the fired heater 10. The heated feed is delivered to the feed flash drum 15 which is operating at 25 psig. The feed separates in the flash drum 15 to produce (a) 7149 BPD of feed flash vapor at a temperature of 750° F. and (b) 4851 BPD of feed flash liquid at a temperature of 750° F. The feed flash vapor flows to the fractionator 20 wherein it is separated to produce 14.4 BPD of overhead off gas, 544.1 BPD of light straight run gasoline, 1790.5 BPD of naphtha, 1553.4 BPD of kerosene/jet fuel, 2286.6 BPD of diesel, and 960 BPD of No. 6 fuel oil.

The coking drums 35 and 40 are operated on alternating six hour fill and decoking cycles. The liquid product from the feed flash drum 15 is heated by the coker heater 25 to a coking temperature of 980° F. The hot drum feed material is then delivered to the live drum 35 or 40 which is operating at an overhead pressure of 20 psig. During the filling operation, the cracked vapor product produced in the live drum 35 or 40 flows to the coker fractionator 60 at an average temperature of 780° F. and at an average rate of 3686.8 BPD. The hot cracked vapor product is separated in the fractionator 60 to produce 291.1 BPD of overhead off gas, 606.4 BPD of an overhead coker naphtha product, 1551.3 BPD of light coker gas oil, and 1237.1 BPD of a combination heavy and intermediate coker gas oil product.

In the decoking stage, the flow of hot feed material to the decoking drum 35 or 40 will have been discontinued and the decoking drum 35 or 40 is first purged for 30 minutes with 750° F. superheated steam. The purging steam flows through the solid coke product within the decoking drum 35 or 40 and is then delivered to the coker fractionator 60. Immediately following the purging step, the hot solid coke product is allowed to flow from the bottom of the decoking drum 35 or 40. The coke draining stage of the decoking cycle lasts for 5.5 hours. The hot coke product material flows from the bottom of the decoking drum 35 or 40 at a temperature of 980° F. The top pressure within the decoking drum 35 or 40 during the coke draining stage is maintained by pressure control valve 65 at 40 psig using 750° F. superheated steam. The solid coke product is cooled to a temperature of 600° F. in the feed preheat exchanger(s) 5 and is then further cooled to a temperature of 250° F. in the steam generator 100.

The following table shows the significantly improved results which would be obtained in this example using the inventive delayed coking process versus a typical prior art delayed coking operation.

Coke Product Comparison

| | Prior Art Delayed Coking Operation | Inventive Improved Delayed Coking Process |
|---|---|---|
| Total Coke Product Yield, wt % | 32% | 21% |
| VOC Content, wt % | 8-12% | 2-6% |
| Moisture Content, wt % | 12% | 5% |

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A process for producing a solid petroleum coke product in a delayed coking system, said delayed coking system including a plurality of coking drums with said process comprising:

each of said coking drums operating in alternating delayed coking cycles including a fill cycle followed by a second cycle, wherein during said fill cycle a drum feed material is delivered into said coking drum to form said solid petroleum coke product therein and produce a vapor product which is delivered to a product fractionator, wherein said drum feed material is not delivered into said coking drum when said coking drum is operating in said second cycle, said solid petroleum coke product is not removed from said coking drum when said coking drum is operating in said fill cycle, and said process further comprising the step in said second cycle of removing from said coking drum said solid petroleum coke product which has been formed in said coking drum without quenching said solid petroleum coke product with water or other quenching liquid in said coking drum and without cutting said solid petroleum coke product in said coking drum such that, when removed from said coking drum in said step of removing, said solid petroleum coke product is a flowable material which flows out of said coking drum in solid form.

2. The process of claim 1 wherein each of said fill cycle and said second cycle has a duration of not more than 10 hours.

3. The process of claim 1 wherein each of said fill cycle and said second cycle has a duration in a range of from about 4 to about 8 hours.

4. The process of claim 1 wherein said drum feed material is at a temperature exceeding 980° F. when delivered into said coking drum in said fill cycle.

5. The process of claim 1 further comprising the step in said second cycle, prior to said step of removing, of delivering steam through said solid petroleum coke product while said solid petroleum coke product remains in said coking drum, wherein said steam then flows to said fractionator.

6. The process of claim 1 wherein, in said step of removing, said solid petroleum coke product being removed from said coking drum has a mean particle size in a range of from about 50 to about 400 μm.

7. The process of claim 1 further comprising the step, after a stream of said solid petroleum coke product has been removed from said coking drum, of heating a coker feed stream by indirect heat exchange with said stream of said solid petroleum coke product, wherein said indirect heat exchange occurs in a heat exchanger such that said stream of said solid petroleum coke product and said coker feed stream each flow through said heat exchanger without said stream of said solid petroleum coke product coming into direct contact with said coker feed stream.

8. The process of claim 7 wherein said stream of said solid petroleum coke product is cooled by said coker feed stream as said stream of said solid petroleum coke product flows through said heat exchanger such that said stream of said solid petroleum coke product enters said heat exchanger at a temperature of at least 920° F. and exits said heat exchanger at a temperature of not more than 700° F.

9. The process of claim 8 further comprising the step, after said step of heating said coker feed stream, of flowing said stream of said solid petroleum coke product through a steam generator to produce steam by indirect heat exchange with water, wherein said stream of said solid petroleum coke product is cooled as it flows through said steam generator such that said stream of said solid petroleum coker product exits said steam generator at a temperature of not more than 250° F.

10. The process of claim 1 further comprising the step, after a stream of said solid petroleum coke product has been removed from said coking drum, of producing steam by flowing said stream of said solid petroleum coke product through a steam generator.

11. The process of claim 1 further comprising the step of delivering a coker feed stream to said fractionator and wherein said drum feed material is a bottom liquid product from said fractionator.

12. The process of claim 1 further comprising the step of delivering a coker feed stream to a feed flash vessel and wherein said drum feed material is a liquid product from said feed flash vessel.

13. The process of claim 12 wherein said coker feed stream is a raw crude stream.

14. The process of claim 13 further comprising the step of heating said raw crude stream to a temperature in a range of from about 600 to about 850° F. for delivery to said feed flash vessel and wherein said feed flash vessel operates at a pressure in a range of from about 10 to about 30 psig.

15. The process of claim 12 further comprising the step of delivering a vapor product from said feed flash vessel to a second fractionator different from said coker fractionator and wherein said vapor product is separated in said second fractionator to produce at least a naphtha product, a kerosene product and a diesel product.

* * * * *